United States Patent [19]

Burris

[11] 4,033,046

[45] July 5, 1977

[54] RIFLESCOPE RETICLE

[75] Inventor: Donald J. Burris, Greeley, Colo.

[73] Assignee: Burris Company, Greeley, Colo.

[22] Filed: Feb. 19, 1975

[21] Appl. No.: 551,167

[52] U.S. Cl. ..... 33/297; 350/10; 356/247

[51] Int. Cl.[2] ..... F41G 1/38; G02B 27/32

[58] Field of Search ..... 33/297, 298, 244, 245, 33/242, 233; 350/10; 356/247

[56] References Cited

UNITED STATES PATENTS

| | | | |
|---|---|---|---|
| 3,286,352 | 11/1966 | Schray | 33/297 |
| 3,394,461 | 7/1968 | Thomas | 33/297 |
| 3,470,616 | 10/1969 | Thompson | 33/297 |

*Primary Examiner*—Steven L. Stephan
*Attorney, Agent, or Firm*—Edwin L. Spangler, Jr.

[57] ABSTRACT

This invention relates to a reticle for riflescopes and the like having crossed filaments defining the aiming reference, the center sections of such wires being flattened in a direction parallel to the viewing axis.

7 Claims, 6 Drawing Figures

RIFLESCOPE RETICLE

Reticles having an aiming mark defined by crossed filaments have, of course, been around for a long time and they continue to be quite popular; however, in order to keep the aiming reference as small as possible so as to not obscure the target, the filaments must be kept quite small and, therefore, they become exceedingly difficult to work with. The net result has usually been a compromise of some sort in which the wire diameter is large enough to handle with minimal breakage while, at the same time, blocking out as little of the target as is reasonably practicable.

Some years ago, improved reticles were developed in which the width of that portion of the crossed filaments visible to the viewer at the point of aim was substantially reduced without an attendant sacrifice in strength. Such a reticle is exemplified in U.S. Pat. No. 3,470,616 owned by the W.R. Weaver Company. In this patent, the filaments defining the aiming reference take the form of thin ribbons which are twisted and viewed on edge rather than broadside in the critical area superimposed over the target. Reticles made in this fashion can be fabricated from ribbon stock that is thinner than the diameter of a round wire filament of the same strength assuming, of course, that both are made from the same material. Even so, a ribbon of comparable strength will usually exceed in thickness the flattened section of a round wire filament fabricated in accordance with the teaching of the instant invention.

Thickness alone is not the only standard of comparison, however. For instance, it is exceedingly difficult to control the manufacturing process for forming twisted ribbon filaments so that the section thereof viewed on edge has its broad face precisely parallel to the viewing axis in the critical area that defines the aiming reference. While this can be done and, in fact, is being done, it is by no means a simple operation; instead, it is one calling for highly skilled technicians and precision equipment.

Another shortcoming is that little or no latitude is possible in the configuration of the aiming reference when a ribbon is used because, basically, one is limited to an edge view of two intersecting tapes of uniform thickness throughout their length. With a flattened round wire filament, on the other hand, the shape of the filament in the aiming area is limited only by the shape of the forming die and this, obviously, is virtually unlimited. For example, tapers, steps, round and square dots, etc., are all quite possible in a die-formed wire.

Another solution to the problem is that which forms the subject matter of U.S. Pat. No. 3,286,352 assigned to Leupold & Stevens Instruments, Inc. Here, instead of flattening the center sections of intersecting round wires and arranging them edgewise one behind the other paralleling the viewing axis as taught herein, the center sections are left round while only the end portions are flattened and arranged broadside to the viewer. The above-mentioned reticle has the advantage over that of the instant invention and that of the Weaver patent in that the parallax problems associated with placing the broad surfaces of one filament behind the other are minimized. In recent years, however, the variable power riflescope has become increasingly popular and most manufacturers who had their reticle in the front focal plane had to redesign them to relocate it in the rear focal plane nearest the shooter. The reason for this was that a reticle in the front or "first" focal plane became magnified along with the image of the target while one in the second focal plane at the rear of the scope did not. Accordingly, reticles are commonly located in the second focal plane in both the fixed and variable power scopes nowadays and it can be shown that the parallax problems associated with mounting the broad sections of flattened filaments one behind the other paralleling the viewing axis are negligible when the reticle is in the second focal plane. Thus, the reticle of the instant invention is specifically designed for use in the second focal plane although, obviously, it will work either place just as the Weaver reticle will.

Apart from the negligible parallax problems associated with the instant reticle design, there are a number of distinct advantages not found in the prior art reticles. To begin with, as already mentioned, flattening the center sections of the filaments provides one with the significant option of being able to vary the shape and size of the aiming reference. Many shooters prefer aiming references other than the simple cross hair. Dots of one shape or another, posts, tapers, steps, wedges all find their adherents, yet, up until now, these shapes were only available in etched reticles and the like.

Another advantage is that the terminal ends of the filaments where they attach to the mounting ring or frame remain round and relatively rigid when compared to flattened ribbon-like end portions of the type found in both of the previously mentioned patented reticles. Since a certain degree of stiffness is necessary at the ends of the filaments to prevent their bending, sagging and, most important, breaking under recoil, the ribbon-type filaments as well as the round wire filaments with flattened ends are definitely limited insofar as how thin they can be and still perform as intended. This minimum thickness, of the ribbon or diameter of the round wire, of course, establishes the size of the aiming reference in both of the prior art reticles referred to previously. By way of contrast, the instant reticle filaments can be fabricated from relatively thick stiff wire mashed quite thin in the center, far thinner at any rate than could be tolerated in the end sections of either of the previously discussed filaments. As such, the relatively more rigid supports for the thinner center sections will withstand a great deal of recoil, be less subject to bending, sagging and vibration, and, most important of all obscure less of the target than other reticles using wire or ribbon filaments.

Last, but by no means least, the method by which the reticles of the present invention are fabricated is far simpler and more economical than those used in the formation of the previously-described ones. Instead of having to worry about whether the twisted ribbon twists such that the broad face parallels the viewing axis at the intersection of the filaments, the central section of the filament is mounted in an appropriate jig and mashed so that this relationship is assured. By mounting the unflattened wire in a jig and then flattening it, breakage is reduced to a minimum as the only manual handling of the wire takes place prior to its being mashed and weakened. The unmashed wire can, of course, be of larger diameter than leupold's and still produce a considerably thinner aiming reference. The same is true of the diameter of the wire used in the formation of the instant reticle when compared with the thickness of Weaver's ribbon-like filament.

It is, therefore, the principal object of the present invention to provide a novel and improved riflescope reticle.

A second objective of the invention forming the subject matter hereof is the provision of a reticle using flattened round wire filaments that obscures less of the target than other filament reticles.

Another objective is the provision of a reticle of the type aforementioned that is considerably more rugged than other comparable filament-type reticles presenting the same thickness to the viewer at the point of aim.

Still another object is to provide a reticle for riflescopes and the like that is easier to fabricate than prior art reticles with ribbon-like thin sections.

An additional objective is the provision of a riflescope reticle formed from crossed filaments wherein the aiming reference can be shaped to assume various configurations.

Further objects are to provide a device of the type forming the subject matter hereof which is simple to make, rugged, accurate, economical, versatile and decorative in appearance.

Other objects will be in part apparent and in part pointed out specifically hereinafter in connection with the description of the invention which follows, and in which.

Figure 1:
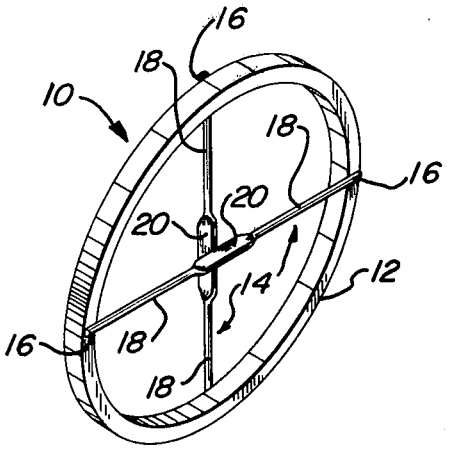
FIG. 1 is a perspective view looking down and to the right upon a reticle having crossed filaments made of round wires flattened in the center where these flattened sections cooperate to define an aiming reference.
Figure 2:
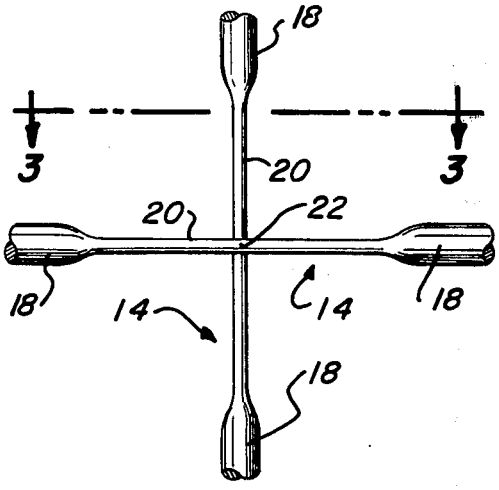
FIG. 2 is a fragmentary front elevation to a considerably enlarged scale showing the flattened sections as they appear to the shooter.
Figure 3:
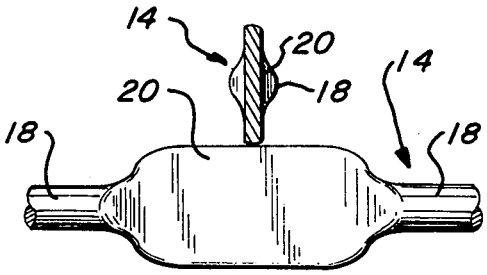
FIG. 3 is a fragmentary section to a still further enlarged scale taken along line 3—3 of FIG. 2.
Figure 4:
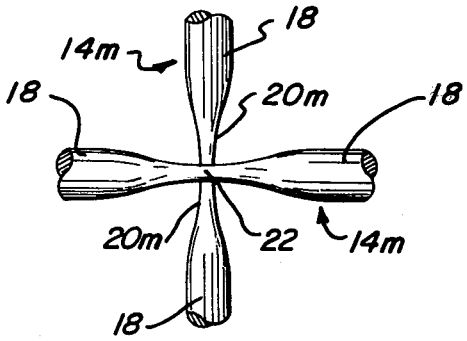
FIG. 4 is a fragmentary front elevation similar to FIG. 2 and to the same scale showing a modified form of filament in which the round end sections taper gradually toward the center to define the flattened sections that cross and define the aiming reference.
Figure 5:
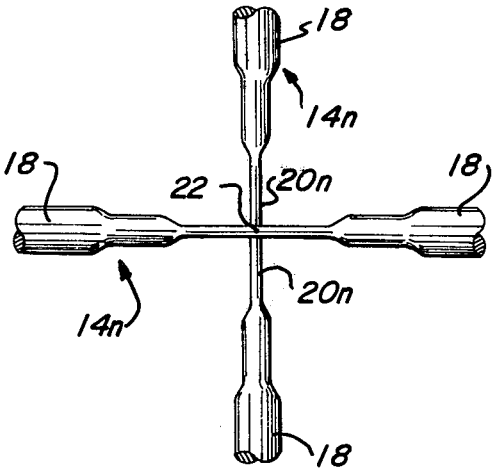
Figure 6:
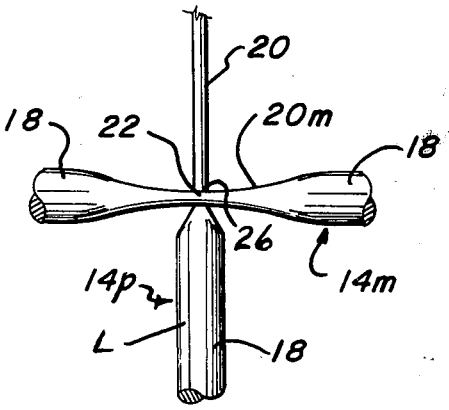

FIG. 5 is a fragmentary front elevation similar to FIG. 2 and to the same scale showing another modification in which instead of tapering the filaments as in FIG. 4, they are stepped down in size from a round section to a first flattened section and then to a second flattened section broader and thinner than the first; and, FIG. 6 is still another fragmentary front elevation much like FIG. 2 and to the same scale showing a further modification using the tapered filament of FIG. 4 for the horizontal filament and the filament of FIGS. 1–3 as the vertical filament except that the flattened section of the latter is shifted so as to lie almost wholly above the horizontal filament.

Referring next to the drawings for a detailed description of the present invention and, initially, to FIGS. 1, 2 and 3 for this purpose, reference numeral 10 represents the improved reticle in a general way and it will be seen to comprise a mounting ring 12 containing crossed filaments that have been broadly referenced by numeral 14. No novelty resides in the mounting ring nor in the way in which the filaments are attached thereto which is traditionally by means of a simple solder joint 16 at the terminal ends of each filament.

The filaments, however, are considered novel in that each comprises a length of round wire 18 the center sections of which are flattened as shown at 20. The flattening is done by mashing the wire between a pair of jaws (not shown) so as to produce a pair of flat surfaces on both sides thereof rather than one flat surface while having the surface opposite said flat surface round.

In the configuration shown in FIGS. 1, 2 and 3, the flat surfaces on opposite sides of the wire are not only planar but parallel to one another; however, FIG. 4 shows an alternate construction wherein the flattened surfaces 20*m* are not parallel but taper inwardly to a point of minimum thickness 22 preferably located at the intersection where the two filaments 14*m* cross and which for purposes of the present description will be denominated the "aiming point." FIG. 5 shows a further modified form of the invention in which the center flattened sections 20*n* are stepped downwardly toward the aiming point from both ends of modified filaments 14*n*.

The aiming point 22 defined by the crossed filaments, both tapered and with parallel flattened surfaces, will obscure a minimal target area. By forming upstanding quarter-round ridges on each center section 20 extending transversely thereof at the intersection or aiming point, a round dot can be produced, however, to do so defeats the purpose of the instant filament as means enlarging the aiming point and obscuring more of the target than necessary. Ideally, therefore, the minimum diameter of each filament should lie precisely at the intersection.

The two filaments need not be alike and FIG. 6 exemplifies a further modification wherein the tapered filament 14*m* of FIG. 4 comprises the horizontal cross hair and a further modified filament 14*p* comprises the vertical cross hair. The only difference between filament 14*p* and filament 14 of the preferred form of the filament illustrated in FIGS. 1–3, inclusive, is that the flattened section 20 lies essentially all on one side (above) the aiming point rather than split approximately half on each side thereof. The result is that the lower half "L" of the vertical filament 14*p* takes on the appearance of a post, the tip 26 of which defines the aiming point. There remain, of course, many other combinations that will work just as well, the one shown in FIG. 6 being merely illustrative of one such possibility.

By way of example illustrating how fine a reticle can be constructed in accordance with the teaching of the instant invention, excellent results have had using 0.0030 diameter wire flattened such that the center sections 20 thereof are only approximately 0.0010 inches thick and about 0.0065 inches wide. Obviously, the aiming point 22 defined at the intersection comprises a square dot only a thousandths of an inch on a side. Such an aiming point when superimposed over the target obscures very little area and, therefore, is ideally suited for use in a riflescope, especially in the rear image plane of a variable power riflescope fitted to a high power rifle used on distant targets.

To insure the fact that the flattened faces 20 of the filaments 14 lie parallel to the viewing axis thus preventing an edge-on view to the shooter, a length of wire is first stretched taut and clamped in the jaws of a tensioning frame. Next, the center section of the wire is mashed to a fine controlled thickness between the jaws of a suitable press. This step is followed by the soldering step where the wire thus formed is soldered permanently to the reticle mount while still secured within the tensioning frame or jig. The first filament having been permanently secured to the reticle mount can, of course, be released from the tensioning frame which is then used in the same way to hold the second filament while its center section is being flattened. After the second filament is formed, it is laid across the first, usually at right angles thereto and, when properly positioned, it too is permanently soldered to the reticle mount usually on the opposite face thereof. This last step is accomplished under a microscope or other suitable magnifier. The final step in the operation is to clean the assembly thus formed and trim the ends of the filaments projecting outside the reticle frame.

What is claimed is:

1. In a reticle for an optical sighting device, the improved aiming reference defining means which comprises: a pair of round wire filaments supported in crossed relation one behind the other, both of said filaments having portions thereof adjacent the intersection therebetween mashed to produced overlapped flattened sections of a thickness substantially less than that of the undeformed wire, said overlapped flattened sections being so located relative to one another and to the viewing axis of the sighting device that the viewer sees only the edges thereof.

2. The improved aiming reference defining means as set forth in claim 1 in which: the opposite portions of both filaments are flattened.

3. The improved aiming reference defining means as set forth in claim 1 in which: the opposite portions of both filaments are flattened and said opposite portions of both filaments lie parallel to one another cooperating to produce a rectangular aiming point where they cross.

4. The improved aiming reference defining means as set forth in claim 1 in which: the opposite portions of both filaments are flattened and said flattened portion of at least one filament tapers inwardly toward the intersection on at least one side thereof.

5. The improved aiming reference defining means as set forth in claim 1 in which: the opposite portions of at least one filament are flattened and said flattened portions taper inwardly toward the intersection.

6. The improved aiming reference defining means as set forth in claim 1 in which: the opposite portions of both filaments are flattened and said flattened portions taper inwardly toward the intersection.

7. The improved aiming reference defining means as set forth in claim 1 in which: the flattened section of at least one filament lies wholly on one side of the intersection.

* * * * *